US005203096A

United States Patent [19]

Rosen

[11] Patent Number: 5,203,096

[45] Date of Patent: Apr. 20, 1993

[54] INSOLE ASSEMBLIES FOR SHOE GIRTH ADJUSTMENT

[76] Inventor: Henri E. Rosen, 229 Coolidge Ave., Watertown, Mass. 02172

[21] Appl. No.: 621,330

[22] Filed: Dec. 3, 1990

Related U.S. Application Data

[63] Continuation-in-part of Ser. No. 337,381, Apr. 13, 1989, abandoned.

[51] Int. Cl.[5] ..... A43B 13/38

[52] U.S. Cl. ..... 36/43; 36/159

[58] Field of Search ..... 36/43, 44, 97; 128/596, 128/600, 601, 605

[56] References Cited

U.S. PATENT DOCUMENTS

| | | | |
|---|---|---|---|
| 2,600,864 | 6/1952 | Fuller | 128/605 |
| 3,091,042 | 5/1963 | Gilkerson | 36/43 |
| 3,624,930 | 12/1971 | Johnson et al. | 36/43 |
| 4,166,329 | 9/1979 | Herbig | 36/97 |
| 4,619,056 | 10/1986 | Lin et al. | 36/43 |
| 4,686,993 | 8/1987 | Grumbine | 36/43 |
| 4,776,109 | 10/1988 | Sacre | 36/43 |
| 4,800,657 | 1/1989 | Brown | 36/44 |
| 4,823,420 | 4/1989 | Bartneck | 36/44 |
| 4,841,648 | 6/1989 | Schaffer et al. | 36/44 |
| 4,897,938 | 2/1990 | Otsuka | 36/43 |

FOREIGN PATENT DOCUMENTS

| | | | |
|---|---|---|---|
| 426359 | 5/1924 | Fed. Rep. of Germany | 128/600 |
| 189717 | 12/1922 | United Kingdom | 128/600 |

*Primary Examiner*—Steven N. Meyers
*Attorney, Agent, or Firm*—Bruce F. Jacobs

[57] ABSTRACT

Footwear having a substantially concealed means for girth adjustment is described. The girth adjustment means is provided by shoe insole assemblies wherein the contours and thicknesses of the side edges vary relative to those of the longitudinally central portions of the insole assemblies which remain substantially constant.

12 Claims, 5 Drawing Sheets

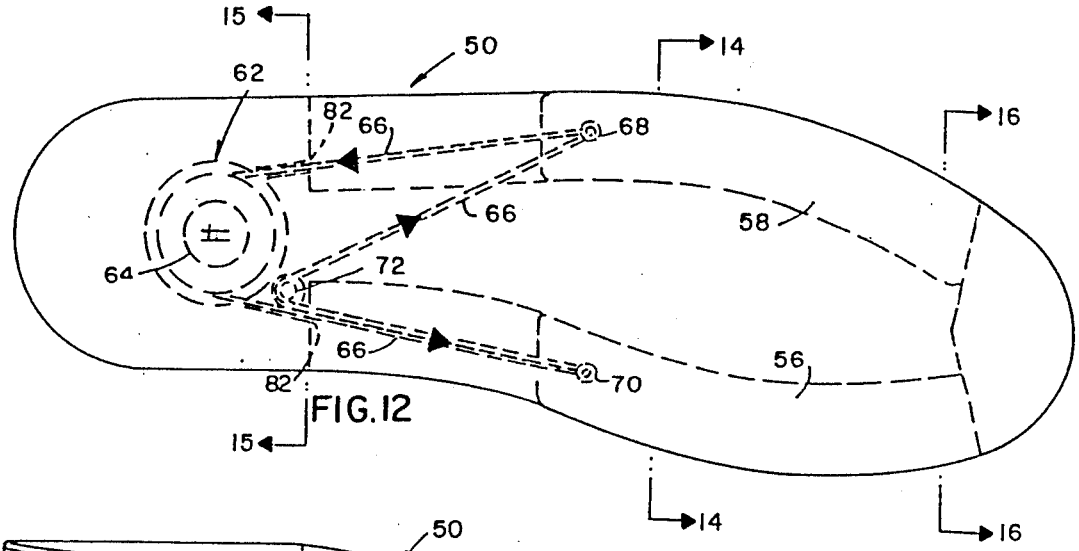
FIG.12
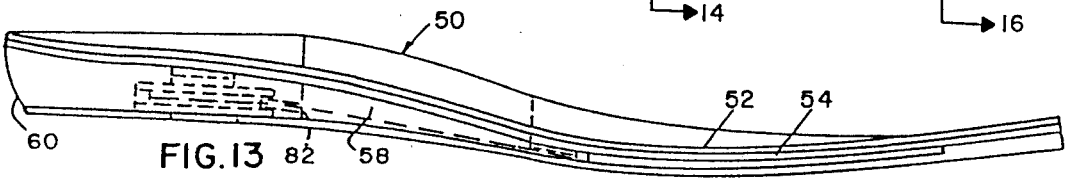
FIG.13
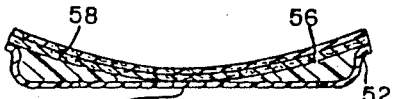
FIG.14
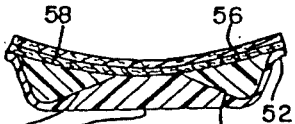
FIG.15
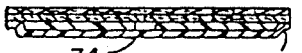
FIG.16
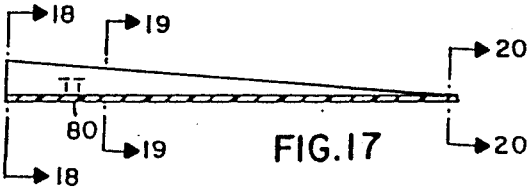
FIG.17
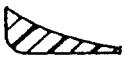
FIG.18
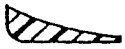
FIG.19
FIG.20

INSOLE ASSEMBLIES FOR SHOE GIRTH ADJUSTMENT

This application is a continuation-in-part of U.S. Ser. No. 07/337,381, filed Apr. 13, 1989, now abandoned.

BACKGROUND OF THE INVENTION

In order for a shoe to fit properly, it should not only be of the correct length, but also should have width and girth dimensions, particularly in the region where the forepart of the foot is enclosed, that substantially match those of the wearer's foot. As used herein, "girth" is defined as the transverse circumference around the forepart of the foot, typically measured at the critical fitting areas including the ball, waist and instep thereof, and is also used to describe the effective inside circumference of the shoe in the same regions.

Ideally, a customer should be able to purchase a pair of shoes having a separate length and width combination for each foot, reflecting the usual dimensional differences therebetween, and the size selection should be made from a full range of some nine or more widths for each length. Furthermore, the customer should be supplied with means to adjust the width of such shoe, particularly in the critical flexing ball region, to allow further possible girth adjustments during use, to compensate for any stretch in the shoe's upper, and for variations in stocking thickness, and particularly for the usual dynamic changes in the foot itself, which normally varies over a range of up to two full width sizes diurnally, with even greater variations experienced under a variety of specific physiological causal factors affecting mainly accumulation of fluid in the extremities such as is often experienced in warm damp weather, in airline flying, and with a variety of illnesses and/or trauma that may produce similar effects.

In practice, however, the so-called 'volume' shoe market, responsible for over 90% of all sales, has found it generally uneconomic to offer shoes in more than one or occasionally two widths, primarily because of the high cost of inventory at the retail level, and the preferred general policy of carrying the widest assortment of styles with the minimum assortment of widths possible. Customers with other than average width feet have a very limited choice, and then usually only at relatively expensive shops, or through mail order operations, both of which are better equipped to handle the inventory problem, although with a considerably more limited choice of styles.

As a result of this situation, it has been accepted that most of all shoes sold provide only an approximate and usually improper fit, particularly in the sensitive and critical ball area where the foot flexes during the stride and where girth adjustment by laces and the like has not proven comfortable or practical.

Attempts to solve this girth adjustment problem by raising the height of the insole, as disclosed in U.S. Pat. No. 3,442,031, have met with limited acceptance, partly since they usually tend to alter the designed tread of the shoe from that of the last on which it was made, "tread" being defined as the relationship of the primarily longitudinal contour of the bottom of the insole in the shoe to the shoe supporting surface, i.e. ground, floor, etc. A further and more profound problem occurs when attempting to correctly fit the usually somewhat differing girths of a person's two feet. Here, the correct fit using this old approach can cause one foot to walk at a higher level than the other, which is orthopedically incorrect and even dangerous not only to the feet, but other portions of the anatomy, including knees, hips, spine and even jaw alignment.

The present invention results from the discovery that the girth of a weight-bearing unshod foot varies significantly with different types of foot supporting surfaces, with the greatest girth produced on a perfectly flat firm surface such as a floor, and the least girth experienced when the same foot is supported by a more conforming surface such as relatively firm but conforming beach sand. This situation holds true for both static and dynamic conditions, with such girth variations found to amount to several consecutive standard width increments. The present invention enables one to duplicate the above conditions faithfully within the shoe itself by its design and construction, and in so doing, to allow the shoe to afford a comfortable and correct fit over a range of several consecutive standard "widths".

SUMMARY OF THE INVENTION

The present invention has as one of its principal objects the construction of a girth-adjustable shoe whereby such girth adjustment is brought about by varying the contours of the surface of the insole while precluding any change in the effective functioning height of the foot from the ground. The girth adjustment can be achieved incrementally over a substantial range of girths from a narrow girth such as from an A-girth (about 8 11/16 inches in a men's shoe size 8) to a wide girth such as an E-girth (about 9 9/16 inches in a men's shoe size 8). The incremental adjustments are preferably at known and accepted girth dimensions, all of which are measured at the ball of the shoe.

It is another object of this invention to provide means to effect such contour and girth variations that will comfortably and correctly fit and support the foot.

It is a further object of the invention to provide for use in such girth-adjustable shoes, systems of girth adjustment that will be safe and simple to use, economical, and adaptable to the widest possible range of footwear styles and uses.

The shoe of the present invention comprises a shoe that can be generally conventional in construction except for being manufactured preferably on a specially designed last of a girth or 'width' equal to the widest width a shoe made thereon is expected to accommodate. Such a last has additional material on its bottom surface to compensate for the volume of the insole that will later be inserted in the finished shoe to adjust the shoe to the maximum of the shoe's designed girth range, i.e. a man's EE shoe should be made on an EE last having extra 'depth' added thereto so that the resulting extra-depth shoe made thereon with a maximum girth insole inserted therein will exactly fit a man's EE foot.

In one embodiment, a set of variously contoured insole assemblies comprising a socklining and an insole support member are provided for each shoe size, whereby the degree of contouring of each of said separate insole assemblies effects, when used in said shoe, a like degree of girth adjustment of said shoe. The insole assemblies can vary incrementally according to the preference of the manufacturer, and may be marked for easy identification thereof, preferably in the customary N/M/W or consecutive letter width markings matching the increments.

Another embodiment of this invention uses an insole assembly which comprises a socklining and a socklining support member in combination with separate shims. The shims, which are disposed underneath the socklining support member, act to contour the outside edges of the socklining support member, with the degree of contour varying relative to the size and/or number of shims used.

A still further embodiment of the invention employs a manually adjustable insole assembly designed for use in those particular cases where relatively frequent girth adjustment may be called for, and where it would be unrealistic to expect the wearer to always have on hand the additional inserts necessary for such adjustments. Such uses could range from the typically hard to fit women's dress shoes, to work shoes, armed service footwear, and athletic footwear.

In all of the above embodiments, each varies the contouring from a lowest substantially constant base line or area which extends approximately along the longitudinal centerline of the insole or insoles mentioned therein. Preferably all of said insoles or insole assemblies will share a common or at least similar cupped heel area, preferably having orthopedically beneficial contours, to which the various contours of the forepart and midsection will be blended, with such blending starting just back of the instep and proceeding to the heel breast, i.e. the forward most portion of said heel cup contours.

For a fuller understanding of the nature and objects of the present invention, reference should be made to the following detailed description taken in connection with the accompanying drawings.

BRIEF DESCRIPTION OF THE DRAWINGS

FIG. 12 is a plan view of an alternative single manually adjustable insole assembly which could be used in a shoe similar to that of FIG. 1, but one having extra depth therein to accept said assembly's extra depth in those areas;

FIG. 13 is a side elevational section of the insole assembly of FIG. 12;

FIG. 14 shows a transverse section of the insole assembly of FIG. 13 taken along waist line 14—14 of FIG. 12;

FIG. 15 shows a transverse section of the insole assembly of FIG. 13, taken along heel-breast line 15—15 of FIG. 12;

FIG. 16 is a transverse section of the insole assembly of FIG. 13, taken along toe line 16—16 of FIG. 12;

FIG. 17 shows a lengthwise view of the lengthwise movable edge ramp shown in FIGS. 12 and 13;

FIG. 18 shows a transverse section of the edge ramp shown in FIG. 17, taken along instep line 18—18 thereof;

FIG. 19 shows a transverse section of the edge ramp shown in FIG. 17, taken along ball line 19—19 thereof;

FIG. 20 shows a transverse section of the edge ramp shown in FIG. 17, taken along toe line 20—20 thereof.

DETAILED DESCRIPTION OF THE INVENTION

Figure 1:
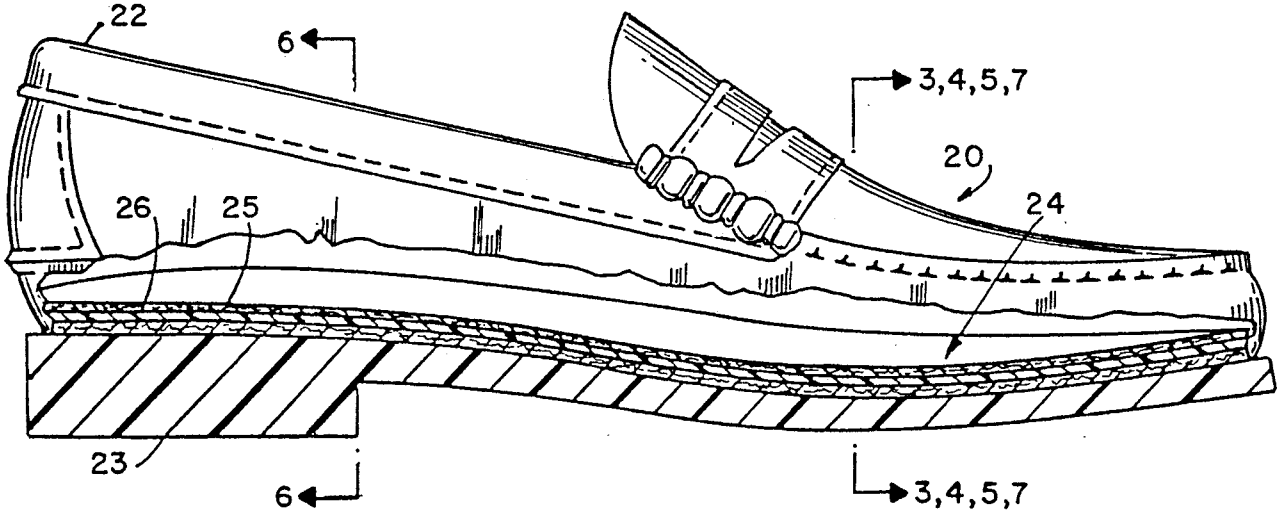
FIG. 1 is a side elevational partially cut-away view of a shoe embodying principles of the present invention.

Referring to the drawings, the adjustable girth shoe construction of the present invention will be described with reference to the well-known handsewn loafer or genuine moccasin, also known in the art as 'tubular' upper construction. It should be understood that this is being done for ease of reference, and that this invention is applicable to most other categories and styles of footwear as well. In the various embodiments described hereinafter, like reference numerals refer to like members which function in the same or similar manner.

Figure 2:
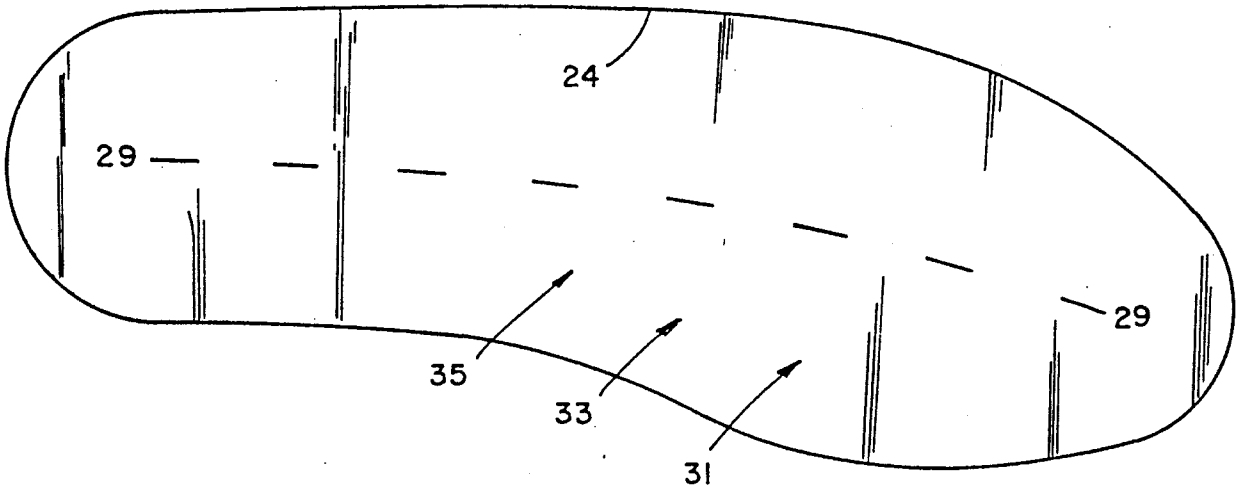
FIG. 2 is a plan view of the insole shown in FIG. 1.

Referring to the drawings, FIG. 1 shows a shoe 20 comprising an upper 22 attached to bottom 23. The upper 22 may be made of any suitable material such as leather, vinyl, or the like. Bottom 23, shown as a unitsole, is made of materials such as rubber, plastic, or the like and is attached to the upper by any suitable means such as stitching, adhesive bonding or the like. Bottom 23 can also be a conventional assembly of bottom elements (not shown) including sole, midsole, heel, welt, shank, and the like. Alternatively, bottom 23 can even be part of the upper as is the case in genuine "camp" or Indian sole-less moccasins. Shoe 20 is manufactured on a last of the widest width and largest girth of the width and girth ranges the shoe 20 is designed to accommodate. Shoe 20 also contains an insertable insole assembly 24 comprising a socklining 25 and socklining support member 26 attached to socklining 25, preferably by molding the two members together, although other suitable attachment means, such as adhesive bonding, may be employed. Socklining 25 is made of a suitable material and as presently preferred is made from Cambrelle® synthetic non-woven fabric, available from Faytex Corp. of Braintree, Mass. Socklining support member 26 is preferably a polypropylene molded part. In the embodiments shown in FIGS. 1-11, a number of different insole assemblies may be inserted into the shoe 20 to achieve different girths which may vary from a fairly narrow girth such as an A-girth to a very wide girth such as the EEE-girth. It is important that the insole assemblies and particularly the outside supporting edges thereof are substantially firm so as not to be compressed under the weight of a person's foot. Only by being firm can the insole assemblies be employed to accurately and effectively adjust the girth of the shoe to a specific desired girth. The different insole assemblies have different surface contours in and near the ball, waist, and instep areas of the foot. As shown in FIG. 2, however, each of the insole assemblies of any matched set, such as shown separately in FIGS. 2-5, 7, and 9-11, has essentially the same thickness generally along the line 29—29 which extends longitudinally down the center of the insole assembly. Each insole assembly varies in countour transversely outward from line 29—29 particularly in the critical fitting zone of the ball 31, waist 33, and instep 35, hereinafter referred to as the "BWI zone." In the embodiment shown in FIGS. 12-21, the insole assembly also maintains a constant thickness along its longitudinal center line.

Figure 3:
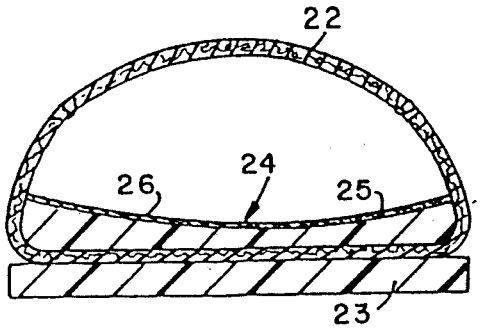
FIG. 3 is a transverse cross-sectional elevation of the shoe of FIG. 1, taken at ball line 3—3 thereof, and shown with an insole assembly contoured to afford less girth when inserted in the shoe of the invention than do those of the insole assemblies shown in FIG. 4 and FIG. 5.
Figure 4:
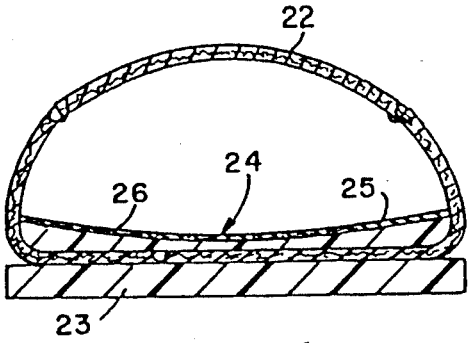
FIG. 4 is a transverse cross-sectional elevation of the shoe of FIG. 1, taken at ball line 4—4 thereof.
Figure 5:
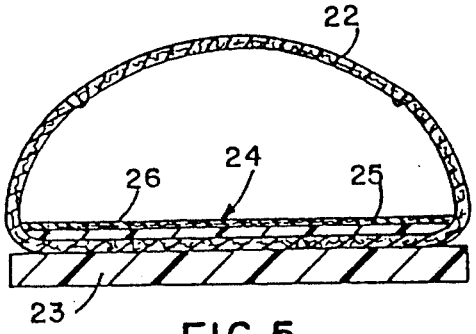
FIG. 5 is a cross-sectional view of another alternate insole assembly to the shoe of FIG. 1, also taken at line 5—5.

FIGS. 3-5 show three different insole assemblies which may be inserted in shoe 20 to achieve different girths. FIG. 3 shows an insole assembly 24 which is of maximum contour in the BWI zone, and therefore adjusts the inside girth of the shoe in which it is placed to a relatively narrow girth such as that of a men's shoe size 8C having a girth of about 9 3/16 inches. FIG. 4 shows the insole assembly 24 of FIG. 1 as it would appear in the same ball line section as that of FIG. 3; however, in this embodiment it occupies less volume in shoe 20 than does insole 24 of FIG. 3, and consequently affords the shoe greater girth, i.e. a medium width having a girth for a men's 8D shoe of about 9 ⅜ inches. FIG. 5 shows a assembly which provides the maximum girth available, often designated as a wide width having a girth in a men's 8E shoe of about 9 9/16 inches. In this latter version, the insole assembly is substantially flat, and of a uniform transverse thickness, substantially the same as that of the central portions of the insole assemblies of FIGS. 3 and 4.

Figure 6:
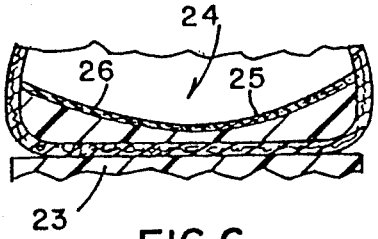
FIG. 6 is a cross-sectional view of the insole assembly shown in FIG. 1, taken along heel-breast line 6—6 thereof.

FIG. 6 shows a preferably, but not necessarily, common heel contour that could be shared by all of the insole assemblies of FIGS. 1-5, and comprises socklining 25 bonded to socklining support element 26. Such a heel contour may also be possessed by the shoe of FIGS. 8-11, hereinafter described.

Figure 7:
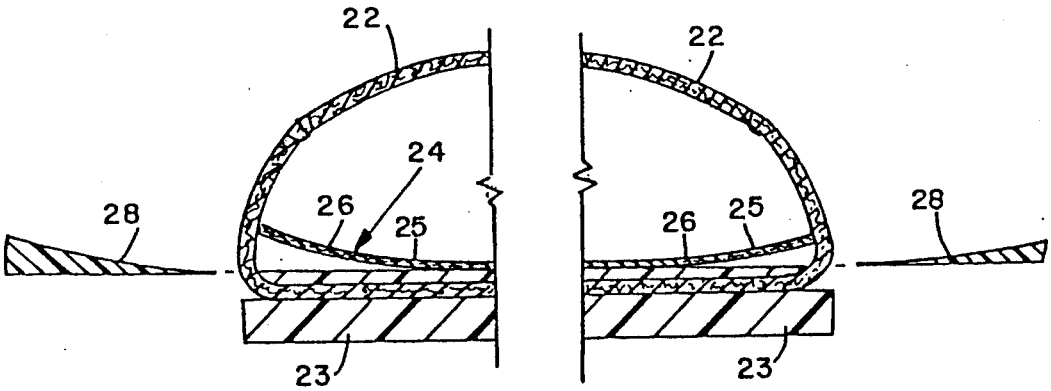
FIG. 7 is a broken cross-sectional view taken at line 7—7 of FIG. 1, of another alternate insole assembly, having removable side edged shims of two typical conformations.

FIG. 7 shows another embodiment with slightly different insole assemblies than those described in FIGS. 3-5. In this embodiment, a single insole assembly 24 comprising socklining element 25 and a socklining support member 26 having side edge openings or slots therebetween to receive shims 28, which can be of any number and thickness, including at least one shim that can be used on each side, and connected preferably at the toe and/or heel. Such shims provide effective insole assembly contours similar to those shown in FIGS. 3-5, and limited in degree to the extremes shown in FIG. 3 and FIG. 5. The shims 28 could be held in place by temporary contact cement, pressure sensitive tape, Velcro®, or similar means, including merely by friction and by the tendency of the upper 22 to hold them in position. In any case, the use of such shims would preferably be limited to those effecting the same type of contouring as that in FIGS. 3-5.

Figure 8:
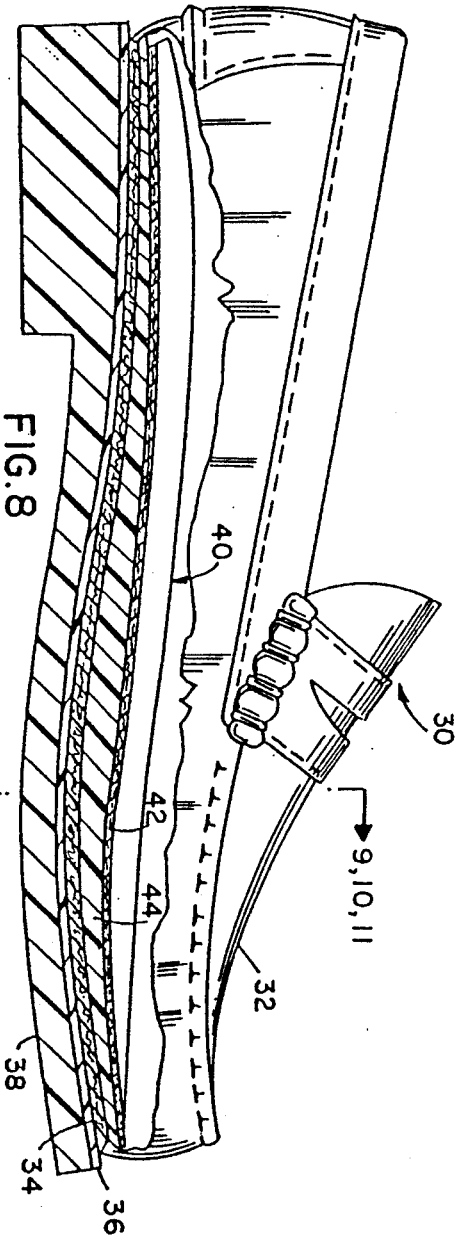
FIG. 8 is a side elevational partially sectional view of a shoe of another embodiment of the present invention.
Figure 9:
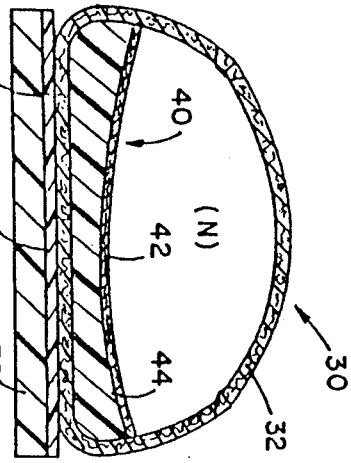
FIGS. 9, 10, and 11 are cross-sectional elevations of the shoe of FIG. 8, taken along lines 9—9, 10—10, and 11—11 respectively, with three typical insoles allowing for three different amounts of girth adjustment.
Figure 10:
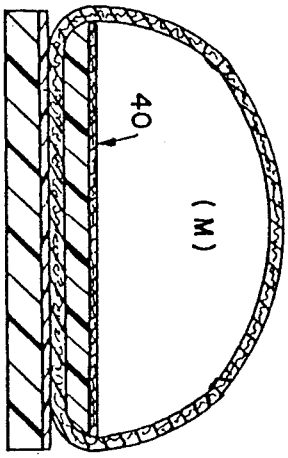
Figure 11:
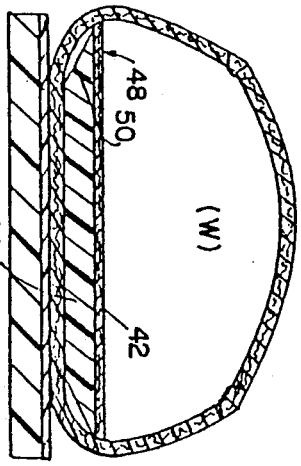

Another embodiment of the invention is shown in FIGS. 8-11. In this embodiment, another set of insole assemblies is shown, similar to those of FIGS. 3-5, except that the central portion of each is thicker than that of the insole assemblies of FIGS. 3-5, to allow an additional type of side edge contouring to facilitate a greater overall degree of girth adjustment than that possible with the insole assemblies of FIGS. 3-5. In this embodiment the girth adjustment can range from a very narrow (AA) girth for a men's size 8 shoe of about 8½ inches to a very wide (EEE) girth of about 9 15/16 inches. FIG. 8 shows the shoe 30 in a side-elevational partially cut-away sectional view, with upper 32, attached by stitching 34 to midsole 36, which is attached to unitsole 38 preferrably by an adhesive. Insole assembly 40, shown in shoe 30 comprises a socklining 42, and socklining support 44, made from the same materials as those described in FIGS. 1-6, and having longitudinally central portions of a substantially greater common thickness than those of FIGS. 1-6. FIG. 9 is a cross-section taken along ball line 9—9 of FIG. 8, showing an insole assembly 40 that when placed in shoe 30 takes up enough of the inside volume of shoe 30 to comfortably but effectively limit the girth of the shoe 30 to the least girth of its designed girth range. FIG. 10 shows another insole assembly 40, again of the same center thickness as that of FIG. 9 to keep the foot height and tread constant, but having a flatter contour along its top surface, to allow shoe 30 with assembly 40 therein to fit a fuller girthed 'M' width foot than the 'N' width accommodated in FIG. 9. FIG. 11 shows still another assembly 48, which is similar to assembly 40, except that edge bevels 50 on the lower side edges of assembly 48 allow another degree of upward motion of upper 32, without necessitating any deformation of sole 38. This extra amount of upward motion of upper 32, together with the flat contour of the top surface of 48 cooperate to allow shoe 30 to have the maximum girth of its designed girth range when assembly 48 is inserted in place therein. Again, as in FIGS. 1-7, the number of inserts and their incremental dimensional differences are optional, as is the use of shims as described in FIG. 7.

Another embodiment of the invention, preferred in situations where immediate adjustment is required, and where the constant availability of the necessary sets of inserts could pose a problem, is shown in FIGS. 12-21. In this embodiment, the effective contours of the forward weight-bearing portions of the top of the midsole in the BWI zone can be infinitely varied between fixed limits, with the preferred contours selected by manual adjustment. The insole assembly 50 is shown in plan view in FIG. 12, and in side section in FIG. 13, and comprises a socklining 52, preferably made of Cambrelle® fabric attached to an innersole 54, preferably made of polypropylene. Under the innersole 54 are longitudinally slidable adjustable edge ramps 56 and 58, preferably molded of relatively firm but flexible plastic material such as cellular ethylene vinyl acetate or the like. The ramps rest on insole assembly base 60, which is preferably molded of polypropylene. The base 60 contains a drum 62 which may be rotated using a screwdriver, coin, or the like inserted in the slotted head 64 of drum 62. As best shown in FIG. 12, cables 66 are attached to and wrapped around drum 62 and are attached to ramps 56, 58 by cable fastenings 68, 70. The cables pass around and/or through grommet 72 and along base 60, under or near the position of fastenings 68, 70. The cable geometry is designed to move both ramps in the same direction. It will be seen that rotation of the drum 62 in a counter-clockwise direction will produce a like amount of cable motion as shown by the arrows on cables 66 to move ramps 56 and 58 rearwardly towards, and eventually to, heel-breast line 15—15. As said ramps move longitudinally, they are preferably contained by and move in tunnels 82 which are formed of a preferably slightly stretchable thin but durable plastic treated so as to be heat sealable or alternately stitchably attached to base 60 at substantially the center 74 of the bottom of same, as best shown in FIG.

15, and at the peripheral edges to innersole 54 and thereby to socklining at heatseal 52. As the ramps 56, 58 move rearwardly they are supported by opposing ramps 76, 78 shown in FIG. 15 at their maximum angle at their rearward end at the heel-breast line 15—15 in FIG. 12. Forward of that location, as shown in FIG. 14, the ramps 56 and 58 gradually flatten to a horizontal condition at ball line 14—14. The use of such opposing fixed ramps 76, 78 facing the movable ramps 56, 58 allows for the simultaneous and identical contour change of the top surfaces of the side edge areas of the insole assembly throughout the BWI zone, which is necessary for optimum and correct girth adjustment in this girth-critical fitting area.

FIG. 17 shows a lengthwise view of the ramps 56, 58 including cable fastening 80 in same. FIGS. 18-20 show cross-sections of ramp 58 taken at lines 18—18, 19—19, and 20—20 respectively. Ramp 56 is essentially the mirror image of ramp 58. It is worth noting that while this assembly as shown appears not to support the side edges of the foot in the shank area, i.e. between the lines 3—3 and 6—6 of FIG. 1, actually, and especially in shoes having raised heel areas, this area is relatively non-weight-bearing and these edge voids consequently cannot be felt by a foot thereon.

Figure 21:
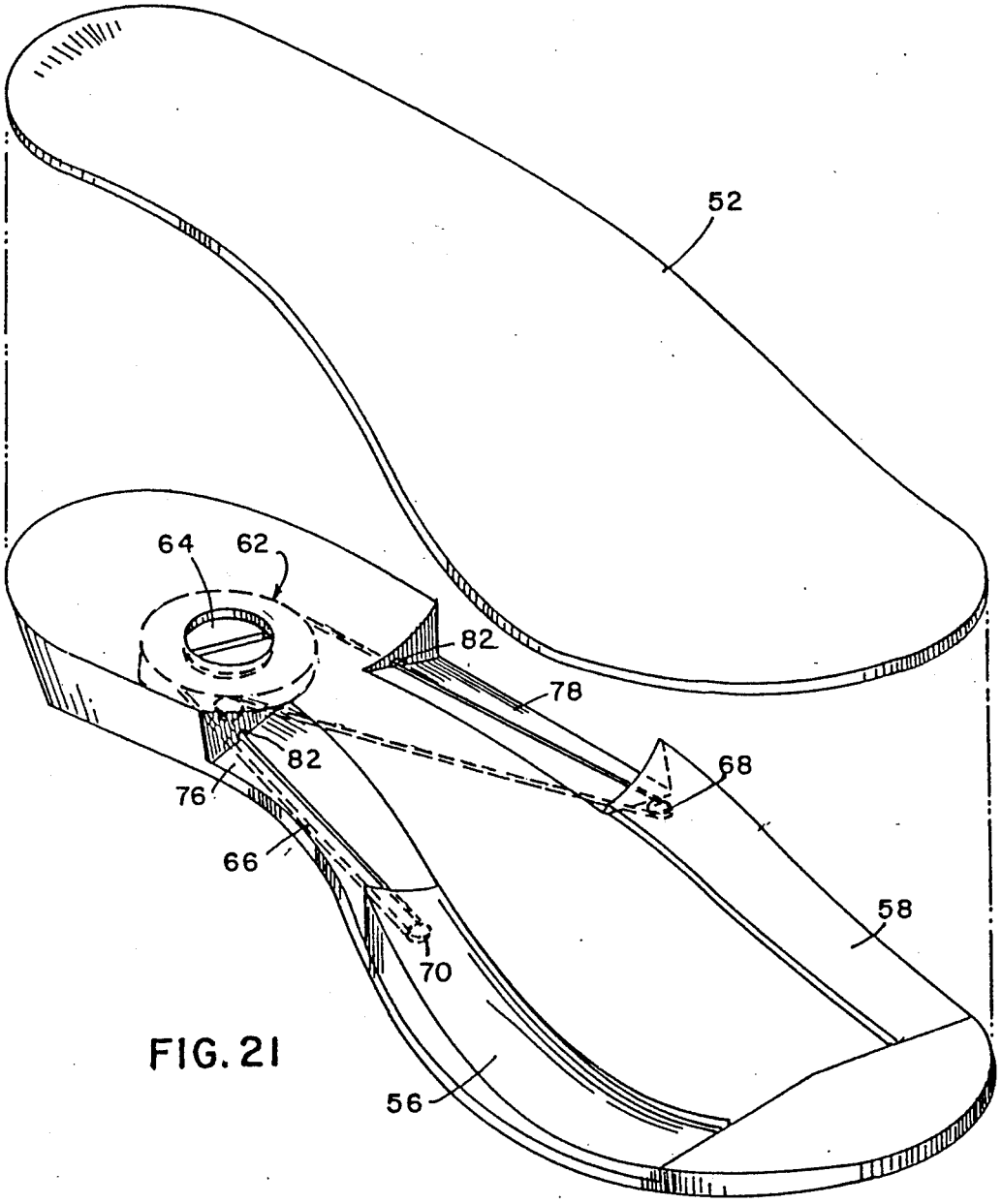
FIG. 21 shows a partially exploded perspective view of the single insole assembly of FIG. 12.

FIG. 21 shows the insole assembly of FIGS. 12-20 in a partially exploded view, eliminating the tunnel wall materials to make this embodiment easier to understand.

What is claimed is:

1. A girth adjustment shoe system for providing a shoe in which the girth may be varied to better fit a foot therein, comprising a shoe having a ball region and having an upper attached to a bottom forming a shoe cavity and a means for incrementally adjusting the girth of the shoe over a range of different girths in at least the ball region of the shoe, and girth adjustment means comprising at least two interchangeable and removable insole assemblies having substantially equal thicknesses generally along their longitudinal center, each insole assembly having a different transverse surface contour and thickness along its side portions when compared to the other insole assembly, each insole assembly comprising a substantially firm member that does not compress under the weight of a wearer's foot and being dimensioned so that there is no substantial change in elevation of the foot relative to the bottom surface of the shoe regardless of the girth adjustments effected by the insole assembly, said at least two insole assemblies being available for use separately within the shoe cavity so as to provide different girths for the same shoe without deformation of the bottom.

2. The girth adjustment shoe system of claim 1, wherein there are multiple insole assemblies each of which has a different contour along its side portions and which can be inserted separately and at different times to provide the same shoe with different girths depending upon the insole assembly which is inserted.

3. The girth adjustment shoe system of claim 1, wherein at least one shim is used in combination with the insole assembly to create the desired contours.

4. The girth adjustment shoe system of claim 3, wherein the insole assembly comprises a socklining and a socklining support and wherein there are at least two firm shims, each disposed between the socklining and the socklining support on opposite sides of the shoe.

5. The girth adjustment shoe system of claim 1, wherein an edge bevel is disposed underneath the insole assembly on each side of the shoe to facilitate girth adjustment.

6. The girth adjustment shoe system of claim 1, wherein the firm member is a molded member.

7. The girth adjustment shoe system of claim 1, wherein the substantially non-variable thickness extends through its forward portion.

8. The girth adjustment shoe system of claim 1, wherein the girth adjustment means adjust the girth of the shoe over a range of girths from a substantially wide girth to a substantially narrow girth.

9. The girth adjustment shoe system of claim 1, wherein the girth adjustment means adjust the girth of the shoe from an E width to a D width.

10. The girth adjustment shoe system of claim 1, wherein the girth adjustment means adjust the girth of the shoe from an E width to a C width.

11. The girth adjustment shoe system of claim 1, wherein the girth adjustment means adjust the girth of the shoe from an E width to a B width.

12. The girth adjustment shoe system of claim 1, wherein the girth adjustment means adjust the girth of the shoe from an E width to a A width.

* * * * *